US012264890B2

(12) United States Patent
Farris et al.

(10) Patent No.: US 12,264,890 B2
(45) **Date of Patent: *Apr. 1, 2025**

(54) PISTOL WITH BUFFER

(71) Applicant: XRAY Aerospace Corp, Claremont, NH (US)

(72) Inventors: Allen Farris, Claremont, NH (US); Charles Bastian, Charlestown, NH (US)

(73) Assignee: XRAY AEROSPACE CORP, Claremont, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/529,929

(22) Filed: Dec. 5, 2023

(65) Prior Publication Data

US 2024/0167779 A1 May 23, 2024

Related U.S. Application Data

(63) Continuation of application No. 17/988,898, filed on Nov. 17, 2022, now Pat. No. 11,867,474.

(51) Int. Cl.

| | |
|---|---|
| ***F41A 3/86*** | (2006.01) |
| ***F41A 3/66*** | (2006.01) |
| ***F41C 3/00*** | (2006.01) |

(52) U.S. Cl.

CPC ..... *F41A 3/86* (2013.01); *F41A 3/66* (2013.01); *F41C 3/00* (2013.01)

(58) Field of Classification Search

CPC ..... F41A 3/86; F41A 3/66; F41A 3/00

See application file for complete search history.

(56) References Cited

U.S. PATENT DOCUMENTS

| | | | | |
|---|---|---|---|---|
| 10,184,738 | B1 * | 1/2019 | Kellgren | F41A 3/88 |
| 11,867,474 | B2 * | 1/2024 | Farris | F41C 3/00 |
| 2005/0247187 | A1 * | 11/2005 | McGarry | F41A 5/04 89/198 |
| 2005/0257413 | A1 * | 11/2005 | Zimmermann | F42B 5/025 42/75.1 |
| 2020/0025470 | A1 * | 1/2020 | Patrick, IV | F41C 23/16 |

* cited by examiner

*Primary Examiner* — J. Woodrow Eldred

(74) *Attorney, Agent, or Firm* — Bennet K. Langlotz; Langlotz Patent & Trademark Works, LLC

(57) ABSTRACT

A pistol with buffer has a frame defining an upper horizontal slide plane, having a forward muzzle end, and defining a receptacle, a slide rail module removably received in a rear portion of the frame receptacle and having a front face, a cross pin engaging the slide rail module to the frame, a buffer received in the frame receptacle and having a rear face abutting the front face of the slide rail module, and a retention portion of the slide rail module configured to contact the buffer to prevent extraction of the buffer when the slide rail module is received in the frame receptacle. The retention portion may be positioned above a selected portion of the buffer to prevent removal of the buffer from the frame when the slide rail module is engaged to the frame by the cross pin. The slide rail module may define a vertical front surface.

14 Claims, 11 Drawing Sheets

PISTOL WITH BUFFER

CROSS-REFERENCE TO RELATED APPLICATION

This application is a Continuation of U.S. patent application Ser. No. 17/988,898 filed on Nov. 17, 2022 entitled "PISTOL WITH BUFFER", which claims the benefit of U.S. Provisional Patent Application No. 63/348,804 filed on Jun. 3, 2022, entitled "MX19 HANDGUN FEATURING REPLACEABLE SHOCK ABSORBING BUFFER AND ONE PIECE ALUMINUM FRAME WITH ONE PIECE BOLT ON GRIP," which is hereby incorporated by reference in its entirety for all that is taught and disclosed therein.

FIELD OF THE INVENTION

The present invention relates to firearms, and more particularly to a pistol with buffer that reduces recoil in a striker fired handgun with a recoil dampening buffer that takes the shock of the slide when being thrust back.

BACKGROUND AND SUMMARY OF THE INVENTION

Semi-automatic pistols use a portion of the energy resulting from the discharge of a cartridge to move the slide assembly, which is typically reciprocating on top of the complete frame. The slide moves rapidly rearwards under recoil force until the slide is stopped by slamming into the pistol frame's front rail module. After many firings, the tabs on the front rail module that receive the brunt of the shock of the impacting slide can wear out, possibly requiring the entire frame of the pistol to be replaced at considerable expense. When the slide reciprocates back and hits into metal instead of the shock absorbing buffer of the current invention, the felt recoil of the firing of the pistol is also increased.

Therefore, a need exists for a new and improved pistol with buffer that reduces recoil in a striker fired handgun with a recoil dampening buffer that takes the shock of the slide when being thrust back. In this regard, the various embodiments of the present invention substantially fulfill at least some of these needs. In this respect, the pistol with buffer according to the present invention substantially departs from the conventional concepts and designs of the prior art, and in doing so provides an apparatus primarily developed for the purpose of reducing recoil in a striker fired handgun with a recoil dampening buffer that takes the shock of the slide when being thrust back and is also removable and replaceable.

The present invention provides an improved pistol with buffer, and overcomes the above-mentioned disadvantages and drawbacks of the prior art. As such, the general purpose of the present invention, which will be described subsequently in greater detail, is to provide an improved pistol with buffer that has all the advantages of the prior art mentioned above.

To attain this, the preferred embodiment of the present invention essentially comprises a frame defining an upper horizontal slide plane, having a forward muzzle end, and defining a receptacle, a slide rail module removably received in a rear portion of the frame receptacle and having a front face, a cross pin engaging the slide rail module to the frame, a buffer received in the frame receptacle and having a rear face abutting the front face of the slide rail module, and a retention portion of the slide rail module configured to contact the buffer to prevent extraction of the buffer when the slide rail module is received in the frame receptacle. The retention portion may be positioned above or to the side of a selected portion of the buffer to prevent removal of the buffer from the frame when the slide rail module is engaged to the frame by the cross pin. The front slide rail module block and frame with these features allow the buffer to be encased and hold into place. It also prevents the buffer from being crushed by the recoil of the slide. The slide rail module may define a vertical front surface. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
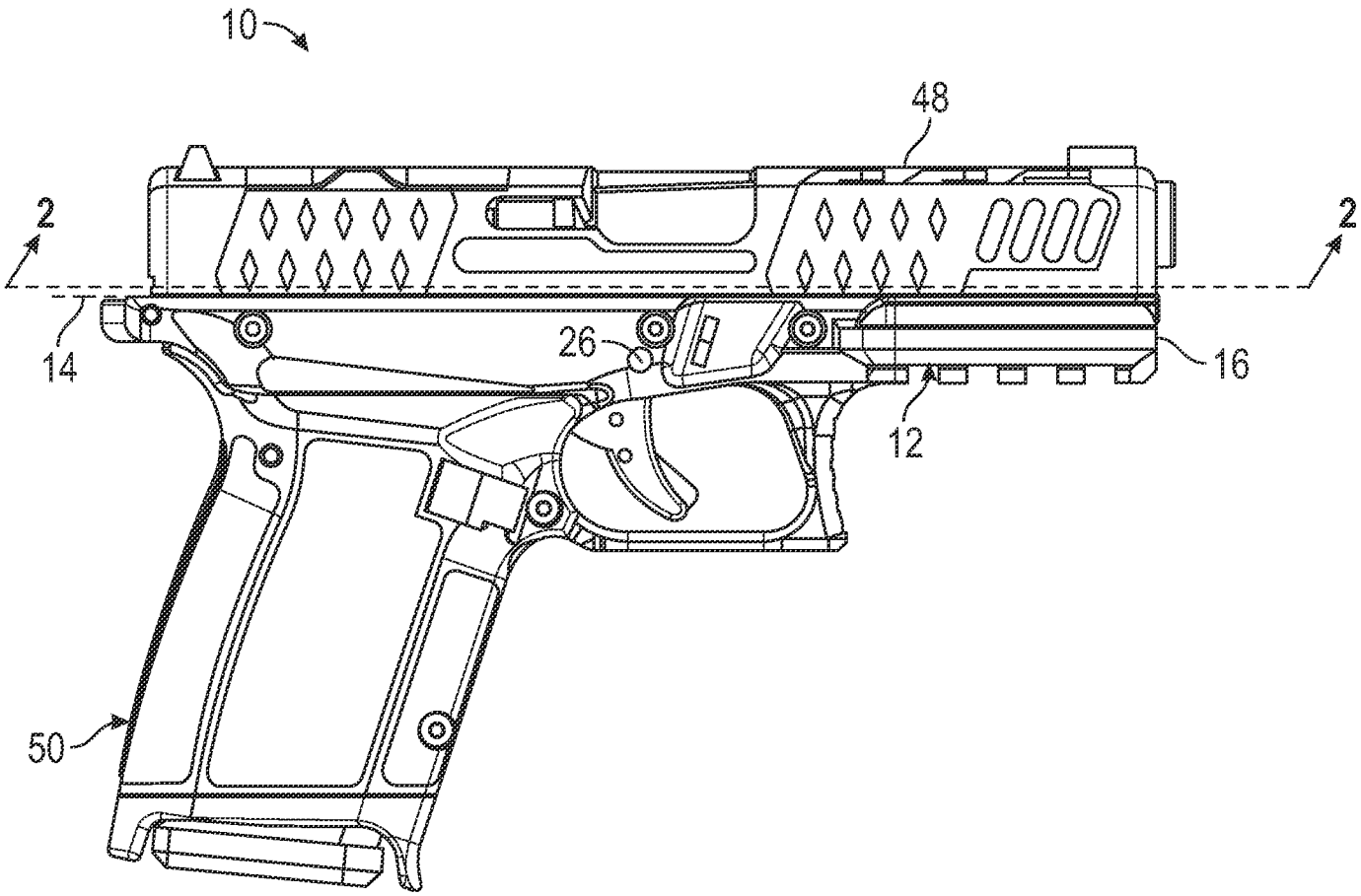
FIG. 1 is a right side view of the current embodiment of a pistol with buffer constructed in accordance with the principles of the present invention with the pistol with buffer in battery.

An embodiment of the pistol with buffer of the present invention is shown and generally designated by the reference numeral 10.

Figure 2:
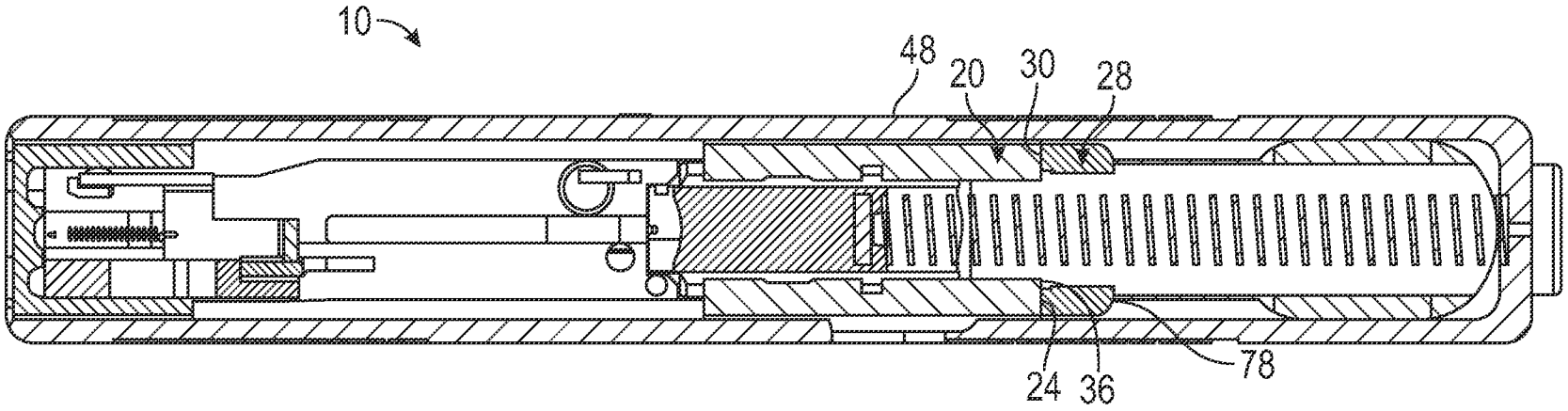
FIG. 2 is sectional view taken along line 2-2 of FIG. 1.
Figure 3:
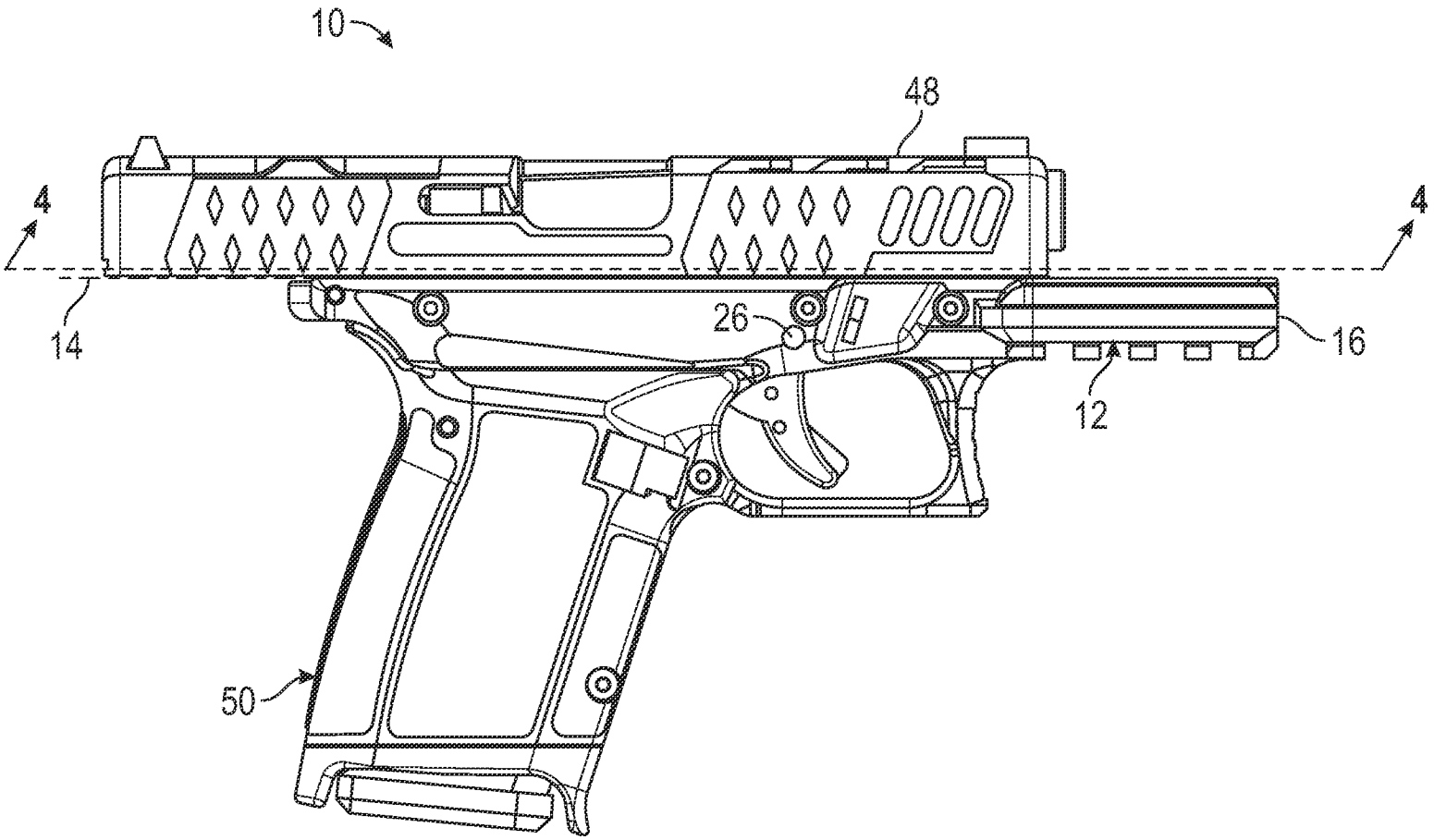
FIG. 3 is a right side view of the pistol with buffer of FIG. 1 with the pistol with buffer in recoil and the slide striking the buffer.
Figure 4:
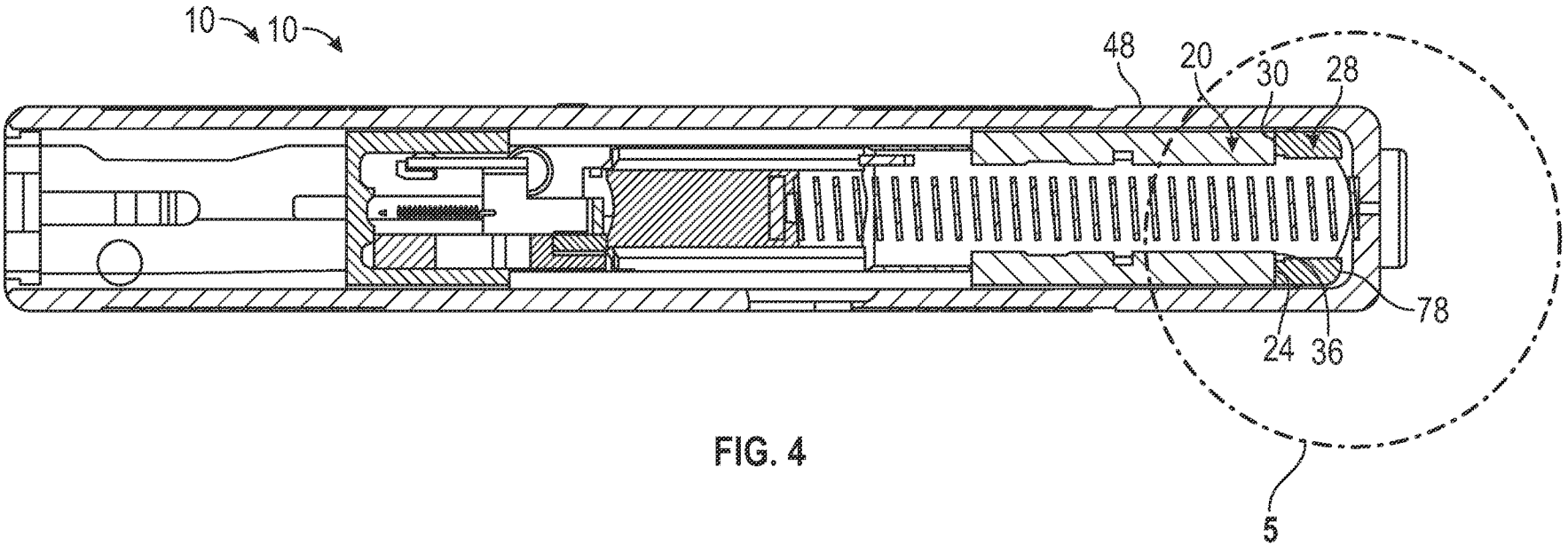
FIG. 4 is a sectional view taken along line 4-4 of FIG. 3.
Figure 5:
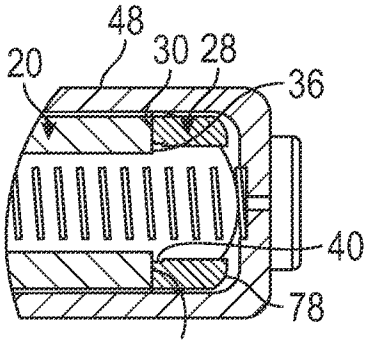
FIG. 5 is an enlarged view of the circled portion 5 of FIG. 4.
Figure 6:
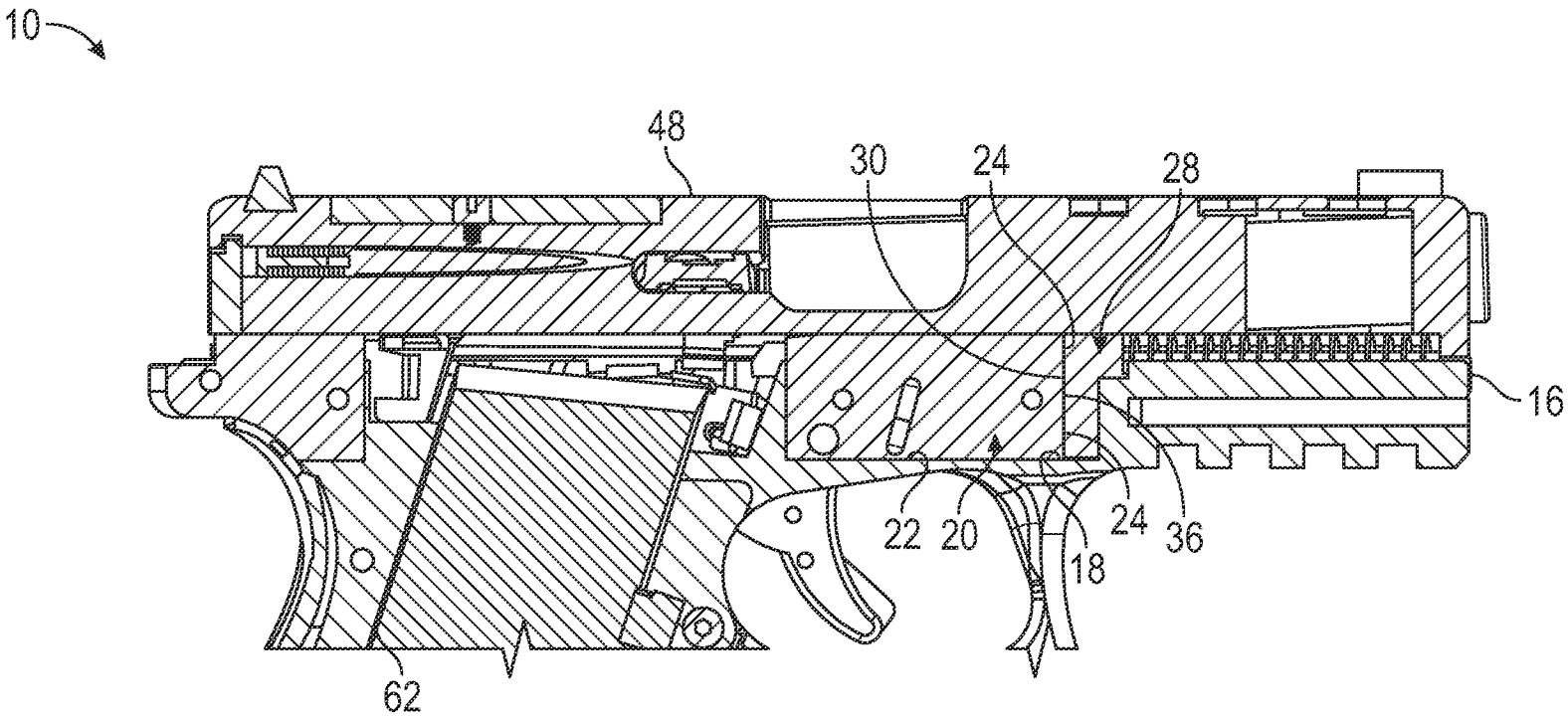
FIG. 6 is a side sectional view of the pistol with buffer of FIG. 1 with the pistol with buffer in battery.
Figure 7:
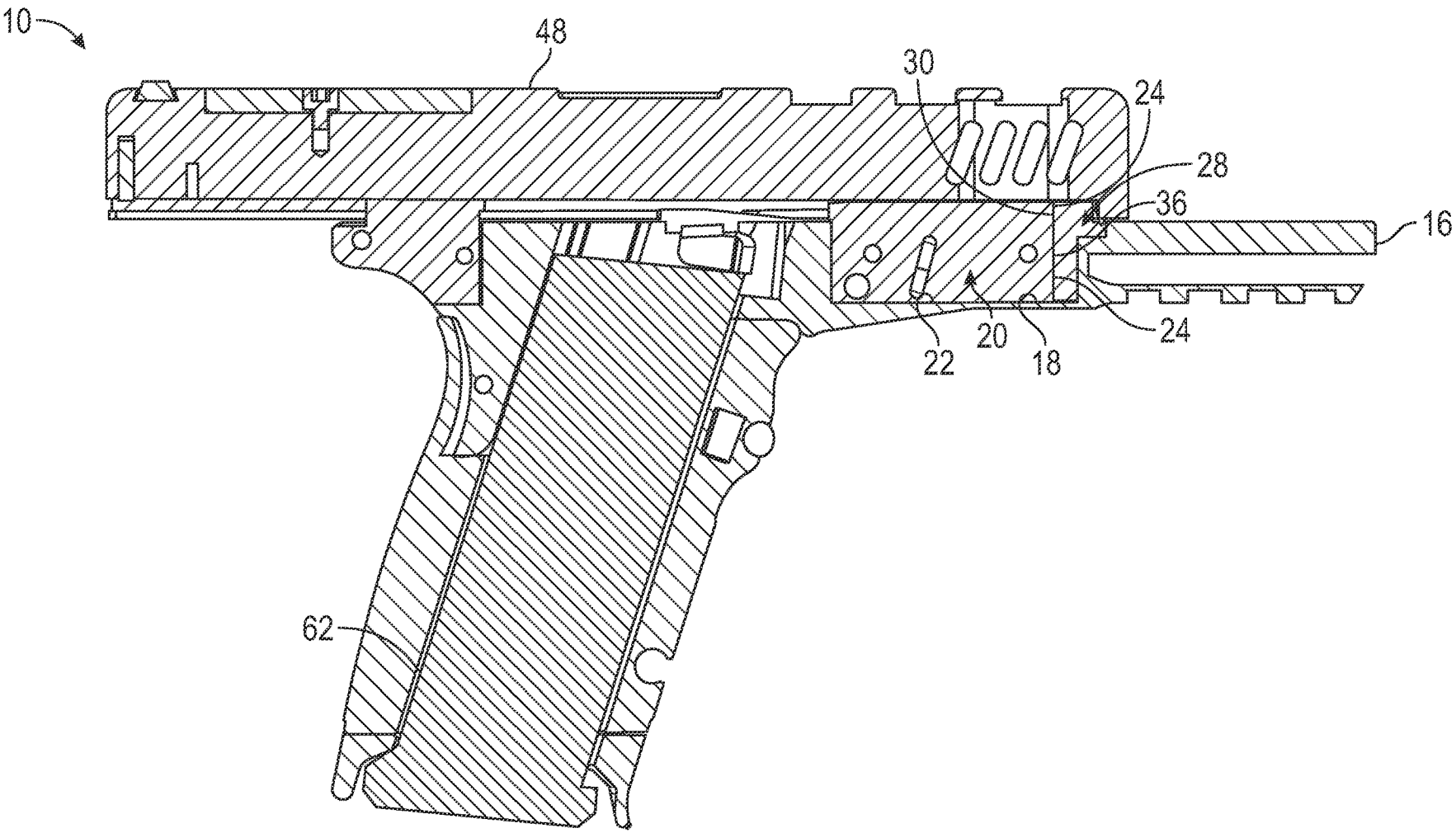
FIG. 7 is a side sectional view of the pistol with buffer of FIG. 1 with the pistol with buffer in recoil and the slide striking the buffer.
Figure 8:
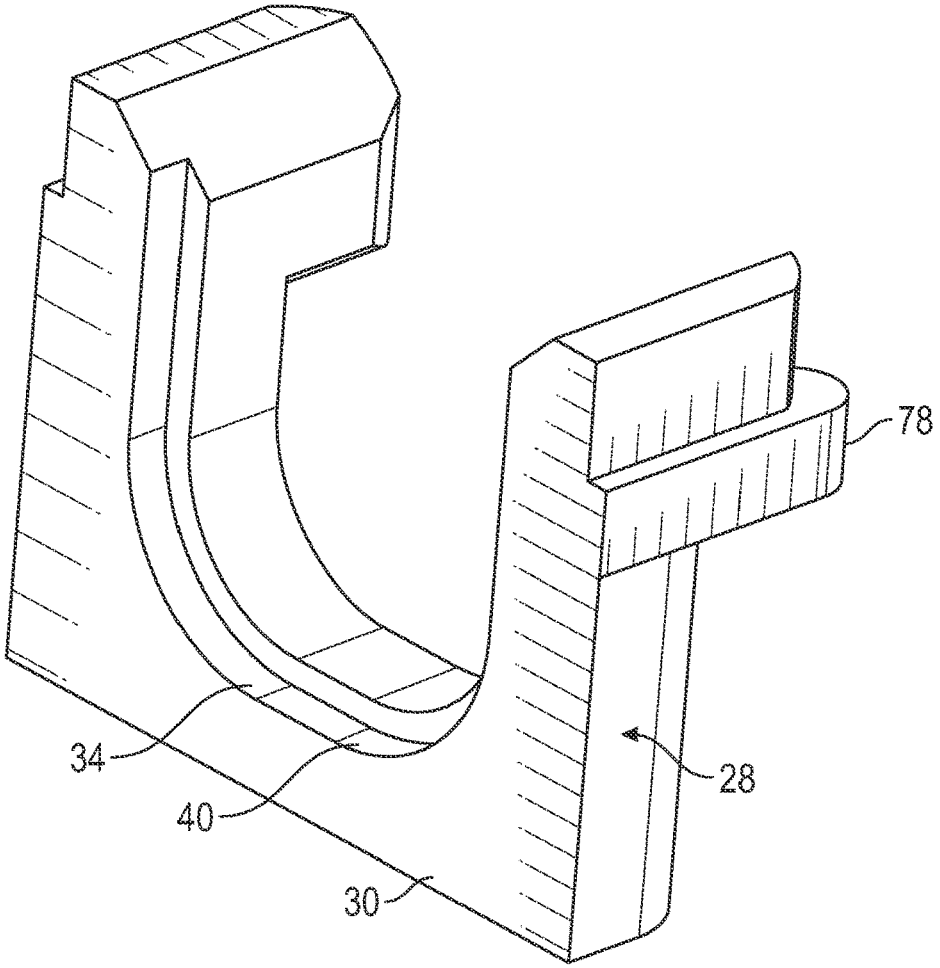
FIG. 8 is a rear isometric view of the buffer of FIG. 2 removed from the pistol with buffer.
Figure 9:
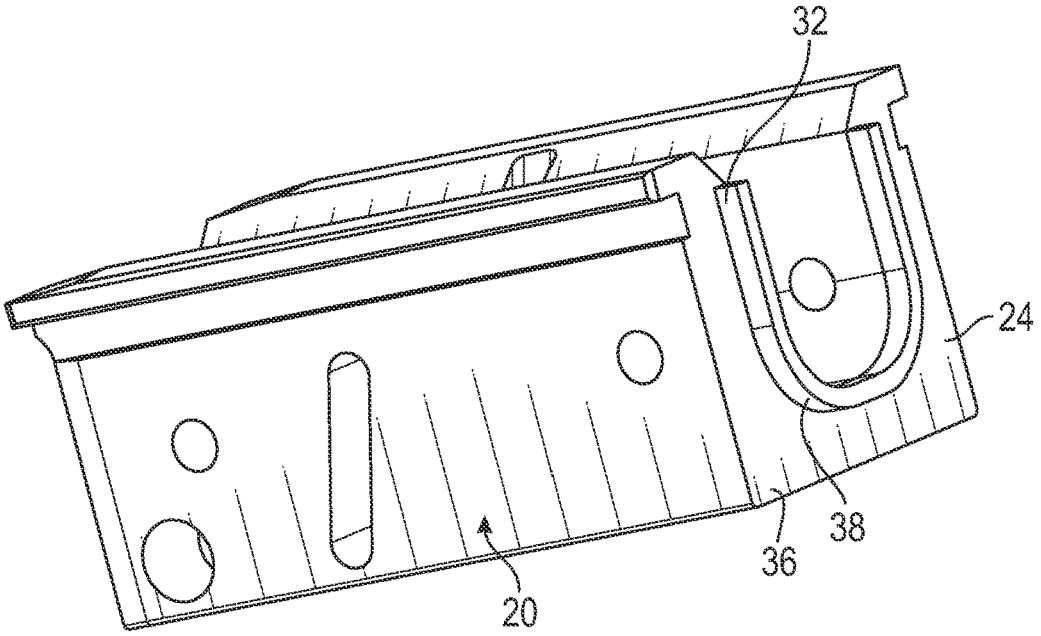
FIG. 9 is front isometric view of the slide rail module of FIG. 2 removed from the pistol with buffer.

FIGS. 1-7 illustrate the improved pistol with buffer 10 of the present invention. FIGS. 8-12 illustrate features of the improved frame 12, slide rail module 20, and buffer 28. More particularly, FIGS. 1, 2, and 6 show the pistol with buffer in battery, and FIGS. 3-5 show the pistol with buffer in recoil with the slide 48 striking the buffer 28. The pistol with buffer has a frame 12 defining an upper horizontal slide plane 14, has a forward muzzle end 16, and defines a receptacle 18. A slide rail module 20 is removably received in a rear portion 22 of the frame receptacle and has a front face 24. A cross pin 26 engages the slide rail module to the frame. A buffer 28 is received in the frame receptacle and has a rear face 30 abutting the front face of the slide rail module or frame. A retention portion 32 of the slide rail module (visible in FIGS. 9-12) is configured to contact the buffer to prevent extraction of the buffer when the slide rail module is received in the frame receptacle.

In the current embodiment, the retention portion 32 or the entire portion of the slide rail module 20 is positioned above a selected portion 34 of the buffer (visible in FIGS. 10 & 12) to prevent removal of the buffer 28 from the frame 12 when the slide rail module 20 is engaged to the frame by the cross pin 26. The front slide rail module defines a vertical front surface 36, and the buffer is forward of the vertical front surface. The retention portion is a flange, which can also be a U-shaped element. Thus, the slide rail module includes a U-shaped flange engaging the buffer, which limits inward flow of the buffer material as the buffer becomes deformed by repeated strikes. The slide rail module and the buffer define U-shaped channels 38, 40 registered with each other. The slide rail module is directly above the frame and free of intervention beneath the slide rail module by the buffer. The entire buffer or a main front contact point of the buffer is forward of the cross pin. The frame is a first material, the slide rail module is a different second material, and the buffer is a different third material. The frame and slide rail module are metal, and the buffer is non-metallic. In a preferred embodiment, the frame is aluminum, the slide rail module is steel, and the buffer is polymeric. A suitable material for the buffer is high impact nylon because it is softer than metal and reduces felt recoil.

Figure 10:
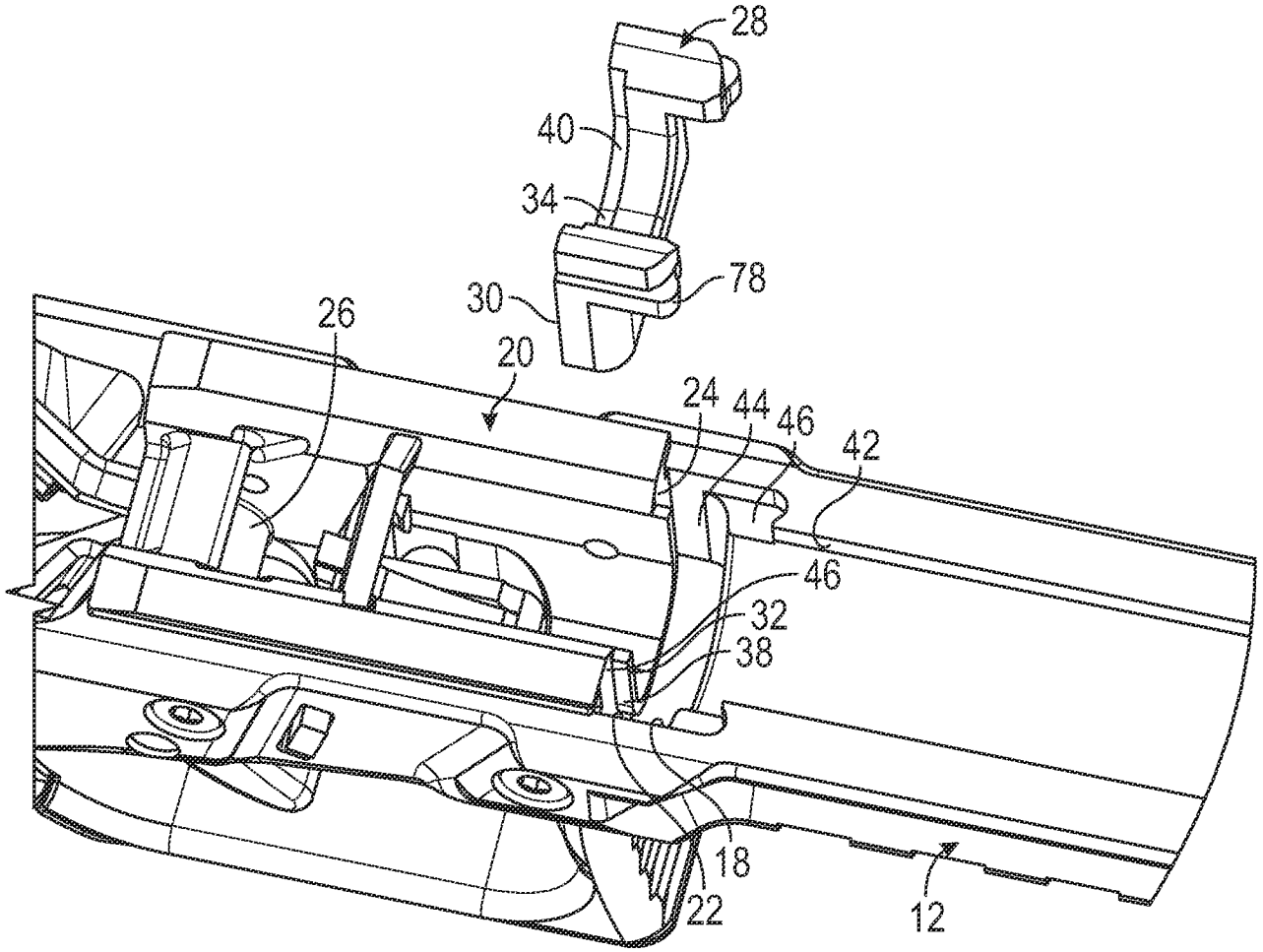
FIG. 10 is an enlarged partial isometric view of the frame of FIG. 1 with the buffer exploded from the frame.
Figure 11:
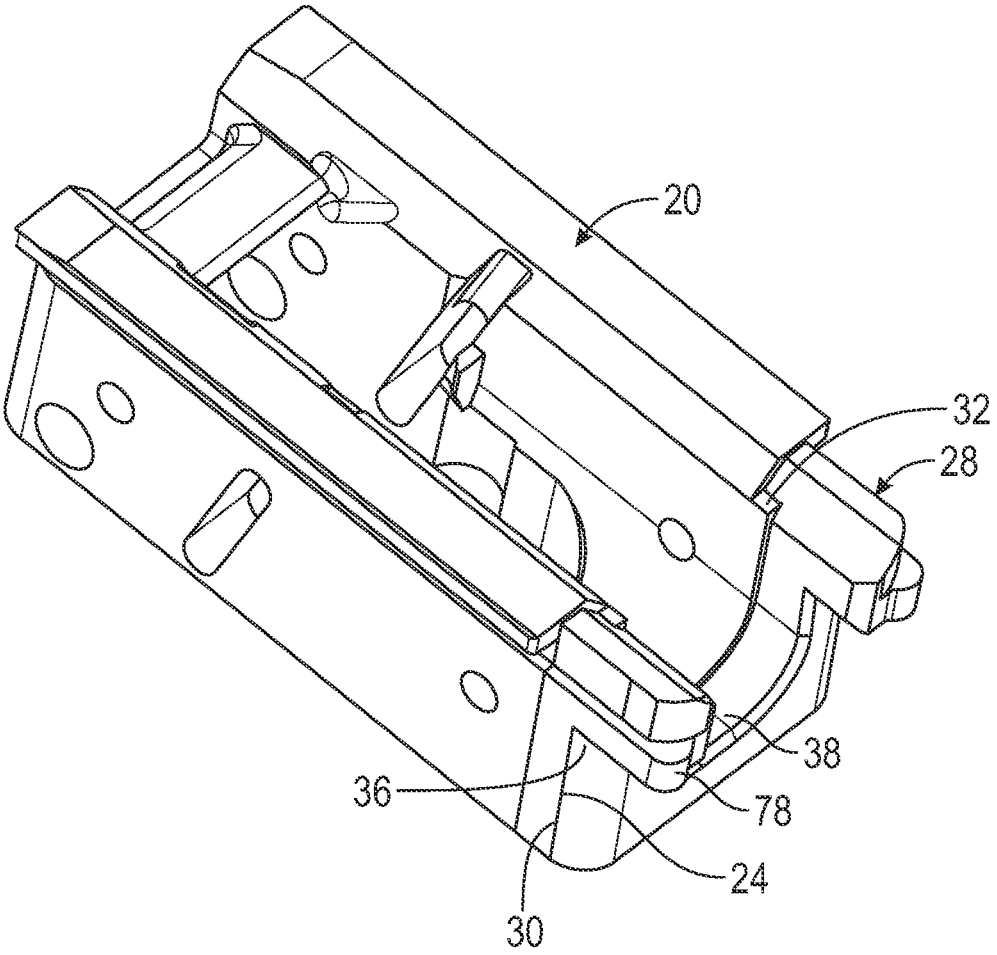
FIG. 11 is a top isometric view of the slide rail module and buffer engaged with one another removed from the pistol with buffer.
Figure 12:
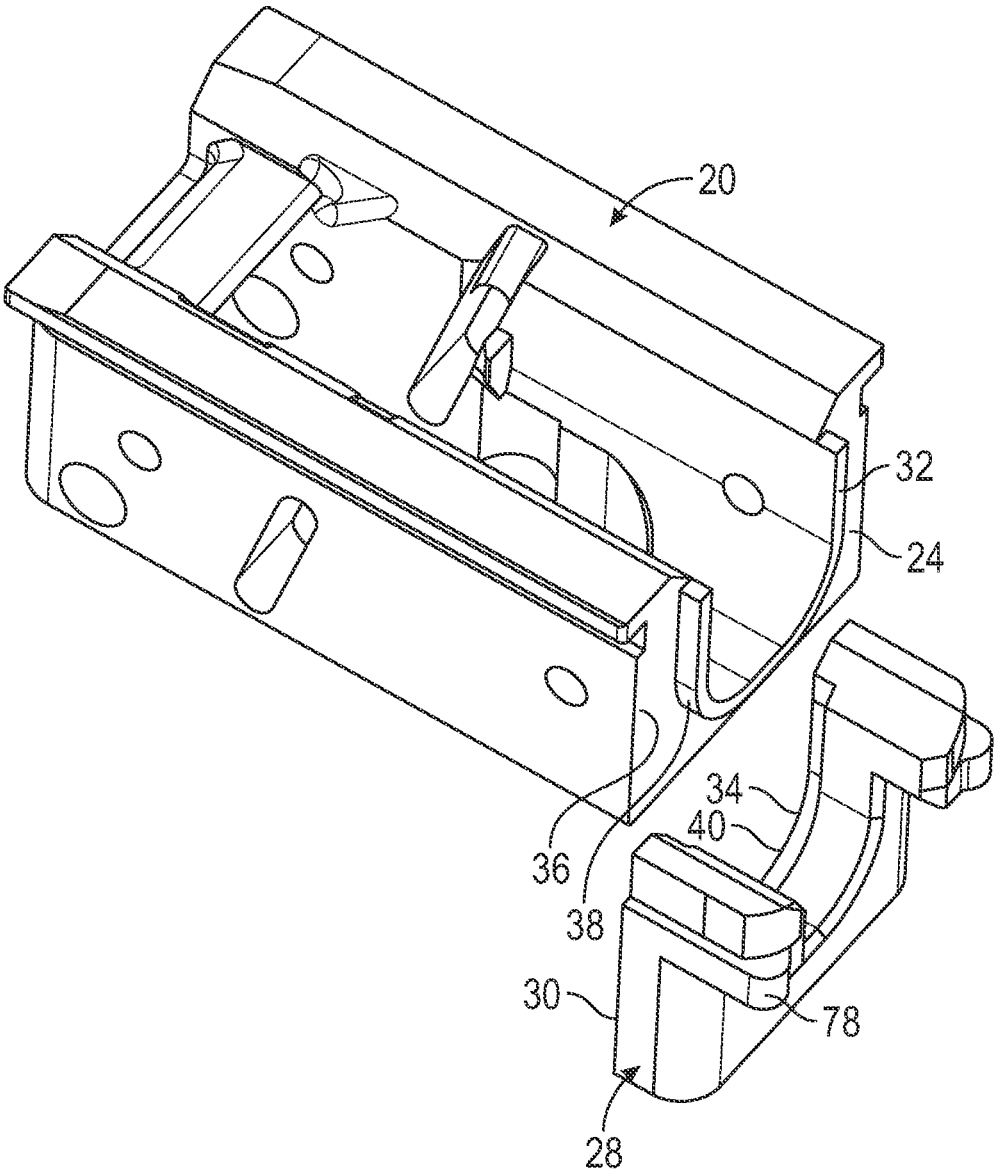
FIG. 12 is a top isometric view of the slide rail module and buffer disengaged from one another removed from the pistol with buffer.

As is shown in FIG. 10, the frame 12 defines a frame channel 42 forward of the buffer 28 having a first width, and the frame receptacle portion 44 receiving the buffer has a greater second width helping encase the buffer and prevent collapsing. The frame defines a step 46 supporting a forward portion 78 of the buffer. The step traps the buffer to prevent the buffer from moving forward away from the vertical front surface 36 of the slide rail module 20.

It should be appreciated that the buffer 28 is removeable for replacement once the buffer has experienced excessive wear when the slide rail module 20 is removed from the frame receptacle 18. The buffer is located in front of the slide rail module and is the first point of impact as the slide 48 kicks back under recoil. The buffer not only protects the vertical front surface 36 of the slide rail module from impact damage, but also reduces impact forces experienced by the slide and buffer. As a result, screws and sights attached to the frame 12 and slide are much less prone to coming loose. Furthermore, the pistol with buffer 10 is less prone to malfunctions such as failure to extract, light strikes, and failure to load. The frame can receive a Glock® compatible trigger mechanism and a standard Glock® 19 gen 3 complete slide, both manufactured by Glock, Inc. of Smyrna, GA.

Figure 13:
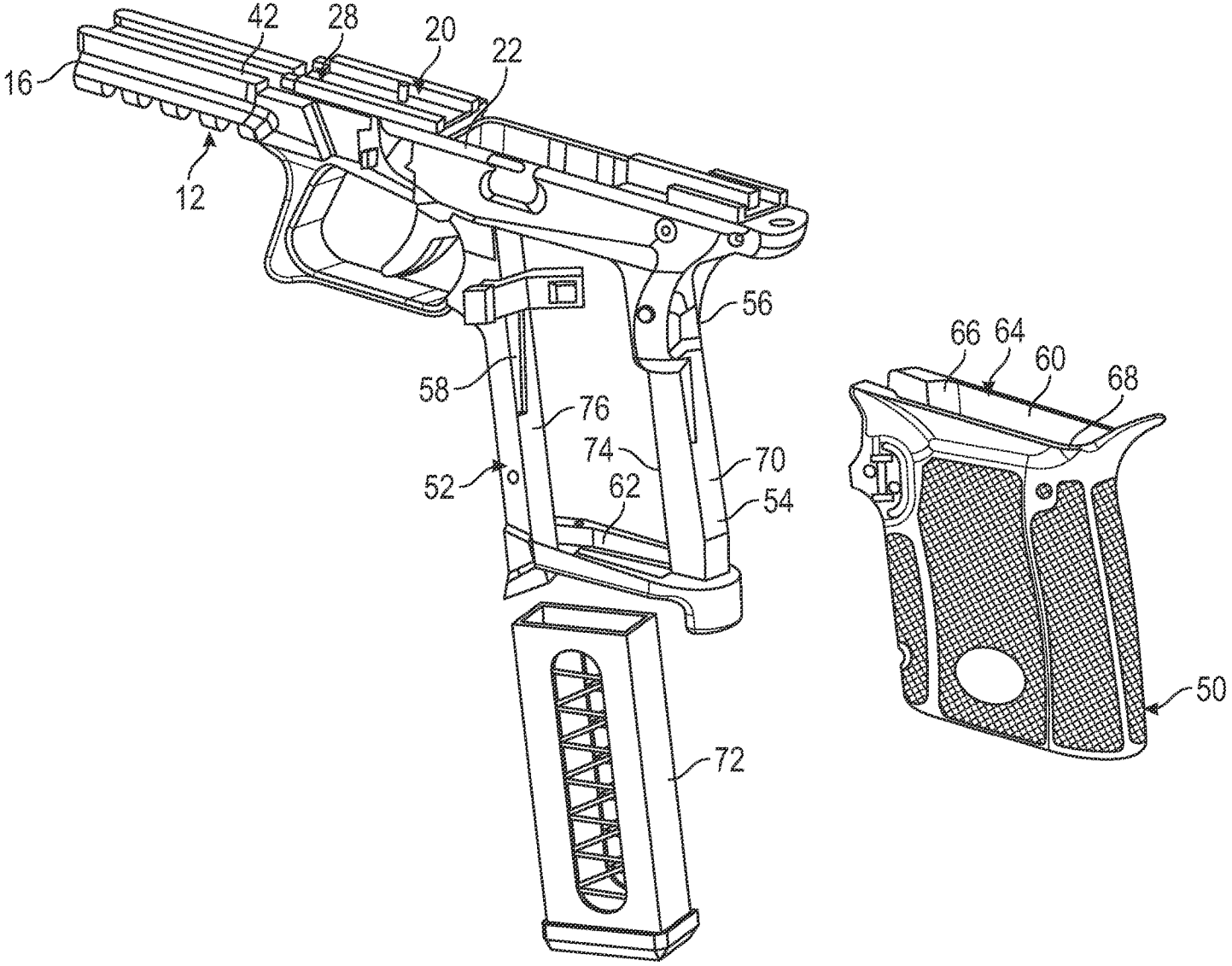
FIG. 13 is an exploded view of the frame and handgrip of FIG. 1.

FIG. 13 illustrates the improved frame 12 and hand grip 50 of the present invention. The frame 12 is preferably manufactured of aluminum to be lightweight while being more rigid than a polymer frame. A more rigid material allows for much tighter tolerances to be held because under recoil, there is a significantly amount of reduced flexing in the frame itself. The frame is a single piece that has a single piece hand grip 50 inserted over and wrapping around the frame base 52 by sliding on from the rear 54 of the frame. The frame base includes machinable access points 56, 58 to enable the frame to be manufactured as a single piece. The hand grip covers both machinable access points when installed. The interior 60 of the hand grip supplements the frame base to further form a magazine well 62 on at least two of the four sides. The interior width of the hand grip defines the magazine well width 64. The interior of the hand grip defines radiused corners 66 and a channel 68 that accommodates the rear bar 70 of the frame base.

The width of the frame base 52 where the hand grip 50 overlays the frame base is less than the magazine well width 64 and magazine width 72. The interior faces 74, 76 on the frame base are flat, which makes them easy to machine. All corners and contours of the magazine well are defined by the interior 60 of the hand grip. Some of the front and rear faces of the magazine well are also defined by the interior of the hand grip.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a pistol with buffer has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pistol comprising:

a frame defining an upper horizontal slide plane, having a forward muzzle end, and defining a receptacle;

a slide rail module removably received in a rear portion of the frame receptacle and having a front face;

a cross pin engaging the slide rail module to the frame;

a buffer received in the frame receptacle and having a rear face interfacing the slide rail module; and a retention portion of the slide rail module configured to interface the buffer to prevent extraction of the buffer when the slide rail module is received in the frame receptacle.

2. The pistol of claim 1 wherein the retention portion is positioned above a selected portion of the buffer to prevent removal of the buffer from the frame when the slide rail module is engaged to the frame by the cross pin.

3. The pistol of claim 1 wherein the slide rail module defines a vertical front surface, and the buffer is forward of the vertical front surface.

4. The pistol of claim 1 wherein the retention portion is a flange.

5. The pistol of claim 1 wherein the retention portion is a U-shaped element.

6. The pistol of claim 1 wherein the slide rail module and the buffer define U-shaped channels registered with each other.

7. The pistol of claim 1 wherein the slide rail module is directly above the frame and free of intervention beneath the slide rail module by the buffer.

8. The pistol of claim 1 wherein the entire buffer is forward of the cross pin.

9. The pistol of claim 1 wherein the frame is a first material, the slide rail module is a different second material, and the buffer is a different third material.

10. The pistol of claim 9 wherein the frame and slide rail module are metal, and the buffer is non-metallic.

11. The pistol of claim 9 wherein the frame is aluminum, the slide rail module is steel, and the buffer is polymeric.

12. The pistol of claim 1 wherein the frame defines a frame channel forward of the buffer having a first width, and the frame receptacle portion receiving the buffer has a greater second width.

13. The pistol of claim 1 wherein the frame defines a step supporting a forward portion of the buffer.

14. The pistol of claim 1 wherein the slide rail module includes a U-shaped flange engaging the buffer.

* * * * *